US005254013A

United States Patent [19]

Tanaka

[11] Patent Number: 5,254,013

[45] Date of Patent: Oct. 19, 1993

[54] PUSH-PULL LOCK CONNECTOR

[75] Inventor: Hideo Tanaka, Tokyo, Japan

[73] Assignee: Hirose Electric Co., Ltd., Tokyo, Japan

[21] Appl. No.: 908,511

[22] Filed: Jun. 23, 1992

Related U.S. Application Data

[63] Continuation-in-part of Ser. No. 659,081, Feb. 22, 1991, abandoned.

[30] Foreign Application Priority Data

Apr. 25, 1990 [JP] Japan ..... 2-43538[U]

[51] Int. Cl.[5] ..... H01R 13/627

[52] U.S. Cl. ..... 439/352; 439/282; 285/86

[58] Field of Search ..... 439/350-352, 439/278, 281, 282, 592, 180; 285/86; 403/325, 329

[56] References Cited

U.S. PATENT DOCUMENTS 4,548,455 10/1985 Ezure ..... 439/152
4,717,351 1/1988 McCormick ..... 439/153
4,810,210 3/1989 Komatsu ..... 439/352
4,915,642 4/1990 Lin et al. ..... 439/350
4,929,189 5/1990 Sekiguchi ..... 439/357

FOREIGN PATENT DOCUMENTS 1048230 11/1966 United Kingdom ..... 439/352

*Primary Examiner*—Larry I. Schwartz
*Assistant Examiner*—Hien D. Vu
*Attorney, Agent, or Firm*—Kanesaka & Takeuchi

[57] ABSTRACT

A push-pull lock connector which includes a square sectioned plug housing (2) for housing a plurality of contacts (22) and has an outer projection (25) on an outside thereof and a first stopper member (26) on the outside above the outer projection; a square sectioned sliding sleeve (3) movable along an upper portion of the plug housing and having a second stopper member (31) which cooperates with the first stopper member to restrict movement thereof; and a pair of leaf springs (4) secured to either the plug housing or the sliding sleeve in a space between the plug housing and the sliding sleeve for biasing the sliding sleeve downwardly.

8 Claims, 5 Drawing Sheets

PUSH-PULL LOCK CONNECTOR

This is a continuation in part of application Ser. No. 07/659,081 filed on Feb. 22, 1991, now abandoned.

BACKGROUND OF THE INVENTION

1. Field of the Invention

The present invention relates generally to push-pull lock connectors and, more particularly, to a squared section, push-pull lock connector.

2. Description of the Prior Art

Japanese U.M. Patent Application Kokoku No. 53-25835 discloses an electrical connector which includes a cylindrical plug housing for housing contacts and having a locking projection for engagement with the locking portion of a mating connector; a cylindrical sliding sleeve fitted over the plug housing above the locking projection and movable for a predetermined distance defined by a stopper; and a coiled spring provided between the plug housing and the sliding sleeve.

To unlock the connector, the sliding sleeve is pulled upwardly against the coiled spring to disengage the locking projections. Under locking conditions, the sliding sleeve is biased downwardly by the coiled spring over the plug housing, thereby keeping the locking engagement.

However, for square sectioned plug housings, it is impossible to use the coiled spring which is wound around the cylindrical plug housing. It is very difficult to make square sectioned coiled springs. Even if made, they hardly stay square sectioned because of spring back effects. In addition, the coiled spring is not secured to the plug housing or the sliding sleeve so that it often that the coiled spring fall upon dissembling, resulting in the low productivity. These problems have hampered the manufacture of square sectioned push-pull lock connectors.

SUMMARY OF THE INVENTION

Accordingly, it is an object of the invention to provide a square sectioned push-pull lock connector.

In accordance with the invention there is provided a square sectioned push-pull lock connector which includes a square sectioned plug housing for housing a plurality of contacts and has an outer projection on an outside thereof and a first stopper member on the outside above the outer projection; a square sectioned sliding sleeve movable along an upper portion of the plug housing and having a second stopper member which cooperates with the first stopper member to restrict movement thereof; and a pair of leaf springs secured to either the plug housing or the sliding sleeve in a space between the plug housing and the sliding sleeve for biasing the sliding sleeve downwardly.

The leaf springs are placed on opposite sides of the square sectioned plug housing so that they work symmetrically. Unlike the coiled springs, the leaf springs are easy and economical to make if the size of plug housings is increased. Since the small leaf springs are secured to either the plug housing or the sliding sleeve, it is not likely that the leaf springs are lost upon dissembling, resulting in the increased productivity.

The above and other objects, features, and advantages of the invention will be more apparent from the following description when taken in conjunction with the accompanying drawings.

DESCRIPTION OF THE PREFERRED EMBODIMENT

Figure 1:
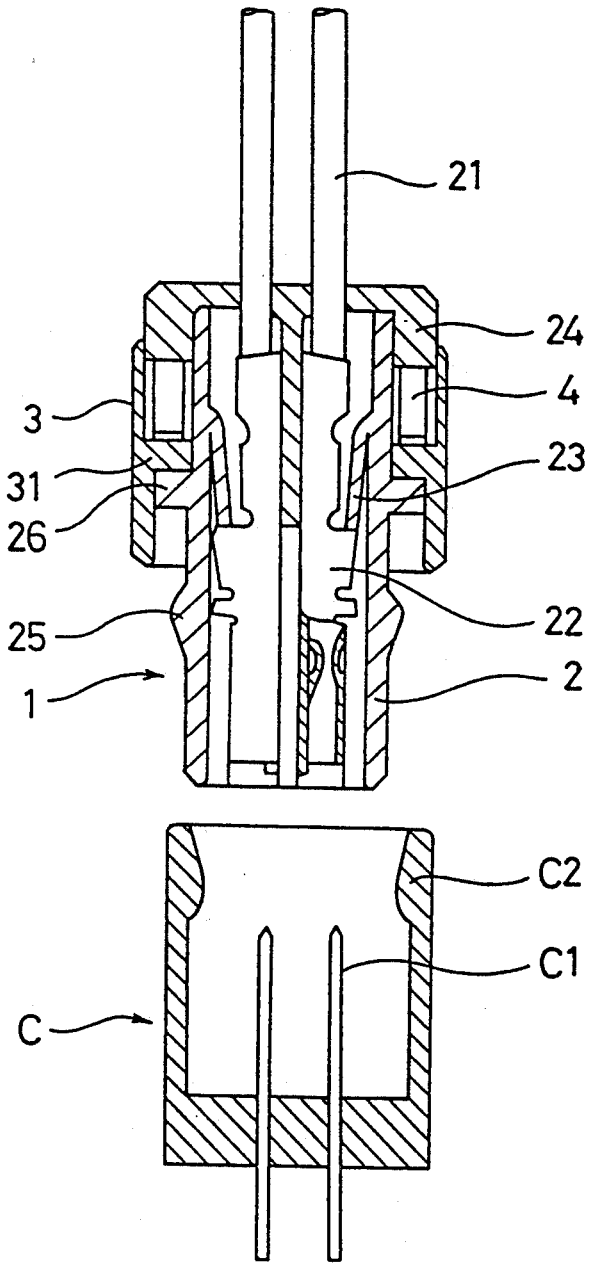
FIG. 1 is a longitudinal section of a push-pull lock connector according to an embodiment of the invention.

FIG. 1 shows a square sectioned push-pull lock connector 1 and a mating connector C. A square sectioned plug housing 2 of the push-pull lock connector 1 is made to have a substantially rectangular cross section and houses a pair of contact terminals 22 to each of which an end of an insulated conductor 21 is crimped. In this embodiment, the contact terminals 22 are made in female form to receive a male terminal C1 of the mating connector C through a front opening of the plug housing 2. The contact terminal 22 is inserted into the plug housing 2 through the top opening and prevented by a resilient latch arm 23 from falling off. A housing cap 24 is fitted over the top portion of the plug housing 2 and holds the insulated conductors 21 in place.

The plug housing 2 has a pair of outer projections 25 on opposite sides and a circumferential flange 26 as a stopper above the outer projections 25 so as to provide a certain length of a space between the lower end of the housing cap 24 and the circumferential flange 26. A sliding sleeve 3 is fitted over and is movable along an upper portion of the plug housing 2 above the outer projections 25. The sliding sleeve 3 has an inner circumferential flange 31 which cooperate with the outer circumferential flange 26 to constitute a stopper to restrict the movement of the sliding sleeve 3.

Figure 2:
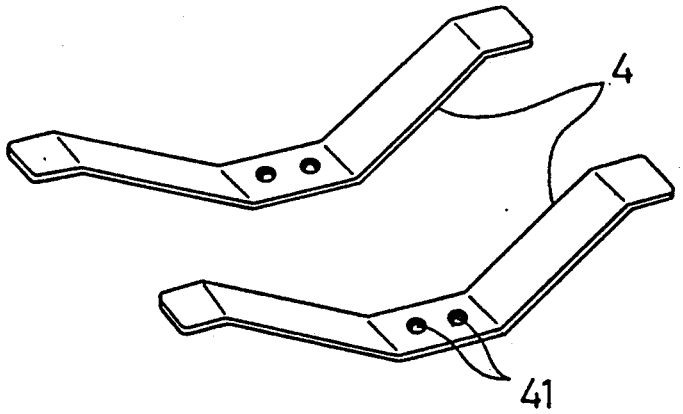
FIG. 2 is a perspective view of leaf springs useful for the connector of FIG. 1.
Figure 3:
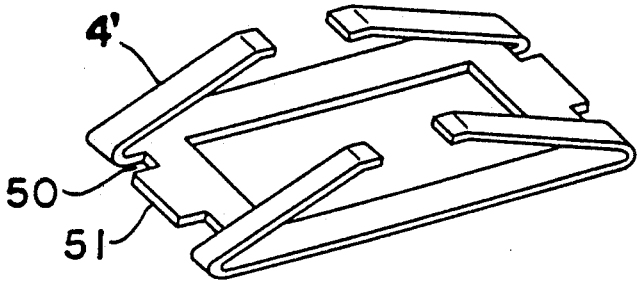
FIGS. 3–5 are perspective views of various modifications of the leaf springs of FIG. 2.
Figure 4:
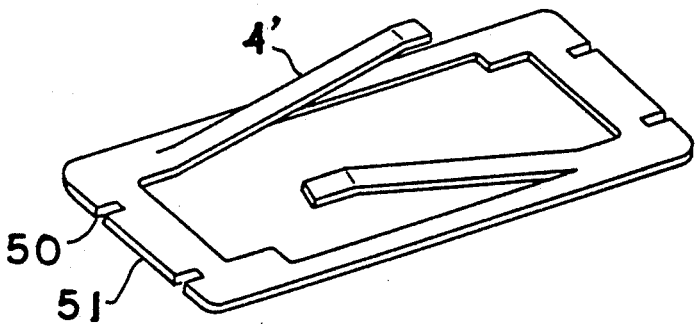
Figure 5:
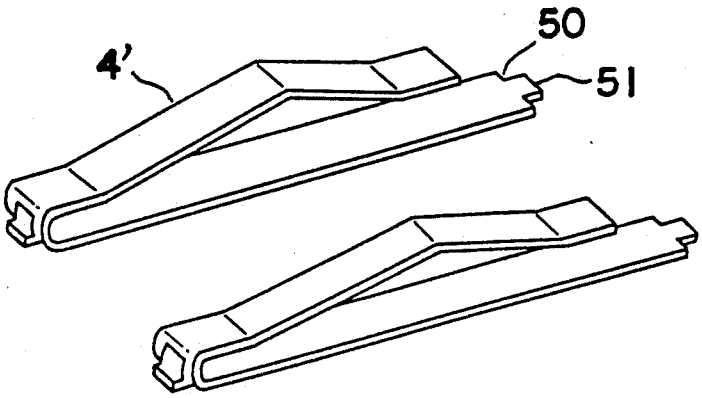
Figure 9:
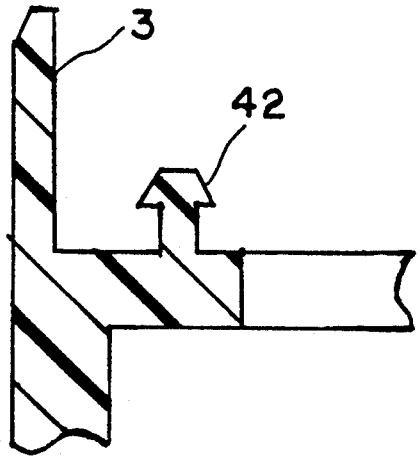
FIG. 9 is a sectional view of part of a sliding sleeve having an engaging lance.
Figure 10:
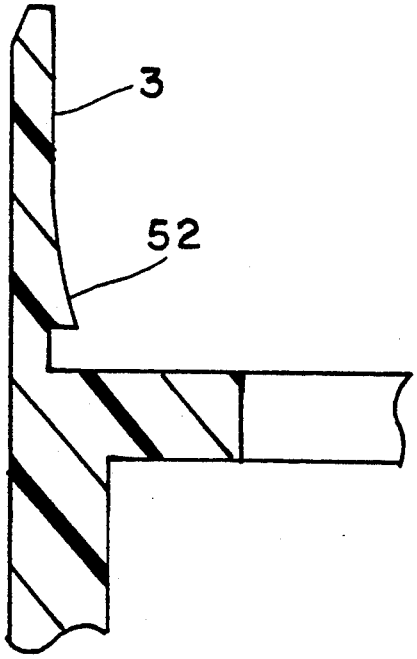
FIG. 10 is a sectional view of pair of a sliding sleeve having a retention projections.
Figure 11:
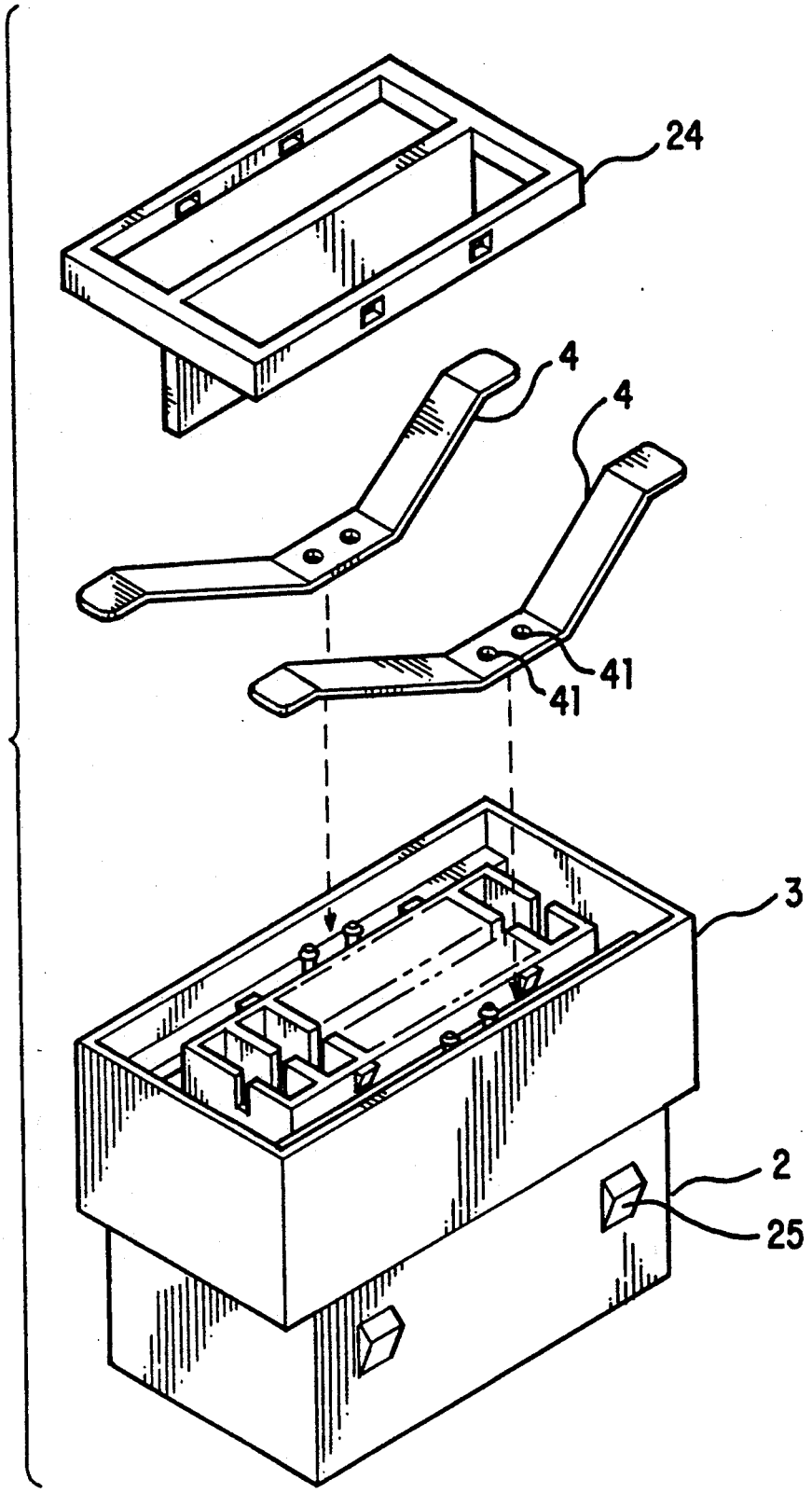
FIG. 11 is an exploded perspective view of the square sectioned push-pull lock connector.

A pair of leaf springs 4 are provided between the inner flange 31 of the sliding sleeve 3 and the housing cap 24 to bias the sliding sleeve 3 downwardly. As FIG. 2 shows, the leaf springs 4 each have a substantially V-shaped form and are placed on the opposite sides of the plug housing 2. The leaf springs 4 are secured to the inner flange 31 of the sliding sleeve 3 at central attaching portions 41. That is, the holes 41 are snapped over lances 91 which are formed on the inner flange 31 of the sliding sleeve 3 as shown in FIG. 9. Various modifications of the leaf springs 4 are possible, and some of them are shown in FIGS. 3–5. The separate types of FIGS. 2 and 5 are easy to make and very adaptable to changes in the width of the plug housing 2 while the integral types of FIGS. 3 and 4 are easy to handle. The leaf springs 41 of FIGS. 3–5 are secured to the sliding sleeve 3 with notches 50 or projections 51 at opposite ends. That is, the leaf spring 4' is pushed into the inside of the sliding sleeve 3 so that the projections 51 of the leaf spring 4' engage retention projections 52 which are formed on the inside walls of the sliding sleeve 3 as shown in FIG.

10. The notches 50 are formed to provide the projects 51 with spring properties.

Figure 8:
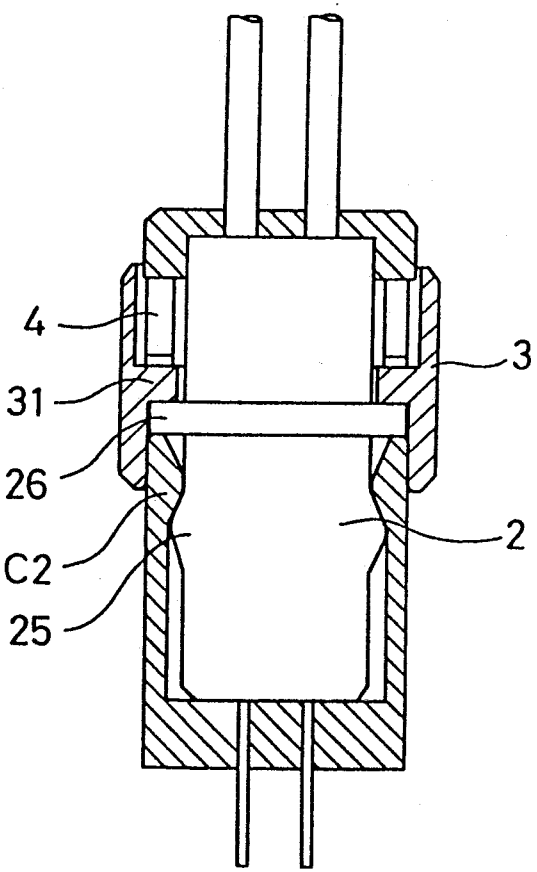
FIGS. 6, 7, and 8 are sectional views useful for explaining how to lock and unlock the connector of FIG. 1.
Figure 7:
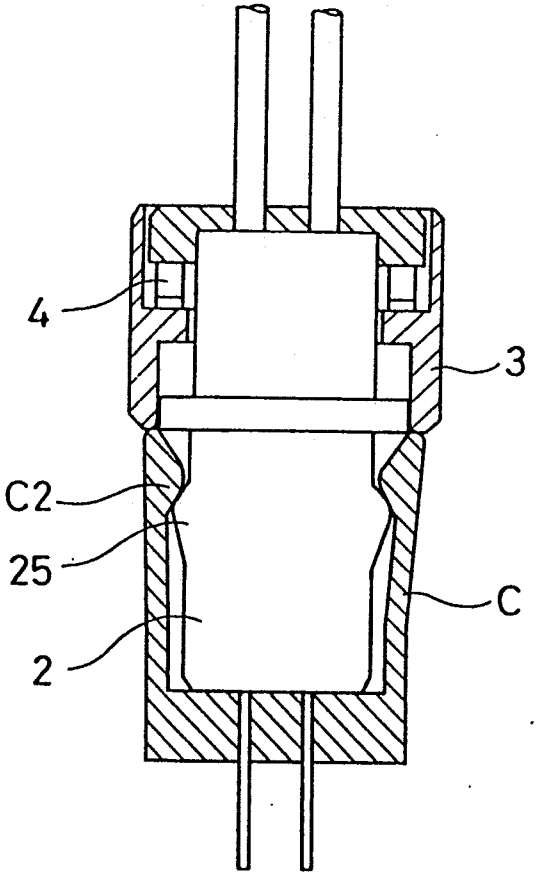
Figure 6:
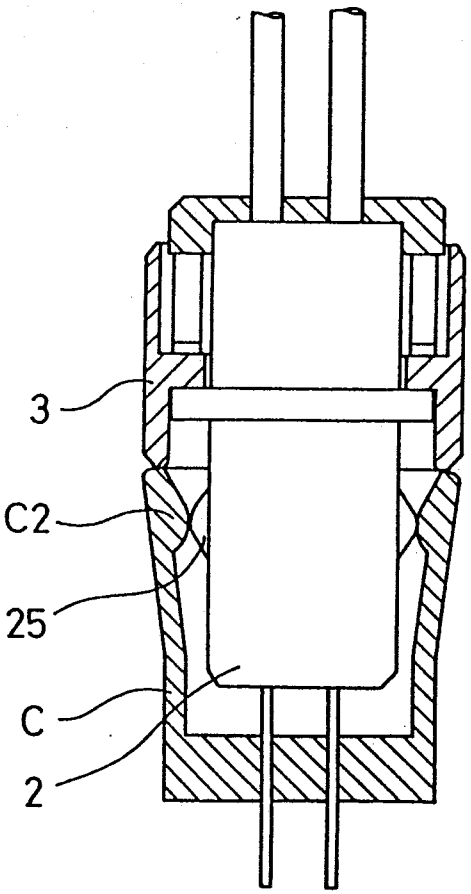

The mating connector C has a cylindrical form and has a pair of inner projections C2 projecting inwardly for engagement with the outer projections 25 of the connector 1. The upper portion of the mating connector is made expandable when the connector 1 is plugged into the mating connector C as described below:

As FIG. 6 shows, the plug housing 2 is inserted into the mating connector C so that the outer projections 25 abut on the inner projections C2 and expands the upper portion of the mating connector as it is further pushed in. Then, as FIG. 7 shows, the lower end of the sliding sleeve 3 abuts on the top edge of the mating connector C, and as the plug housing 2 is further pushed into the mating connector, the leaf springs 4 are compressed. When the outer projections 25 passed the inner projections C2, the top portion of the mating connector C flexes back to its original shape. Consequently, as FIG. 8 shows, the sliding sleeve 3 is pushed downwardly by the leaf springs 4 to fit over the mating connector C. The downward movement of the movable sleeve 3 is restricted by the abutment of the stopper flanges 31 and 26. Thus, the push-pull lock connector 1 is connected to the mating connector C.

To unlock the connector 1 out of the mating connector, the movable sleeve 3 is pulled upwardly against the leaf springs 4 to a position as shown in FIG. 7. Then, as the plug housing 2 is pulled upwardly, the top portion of the mating connector C is expanded by the outer projections 25 as shown in FIG. 6, and the two connectors are separated.

According to the invention there is provided a pair of leaf springs between the plug housing and the movable sleeve, it is easy and economical to make the square sectioned, push-pull lock connector. The small leaf springs are secured to either the movable sleeve or the plug housing so that problems such as being easy to be lost in assembling and dissembling operations are minimized, resulting in the increased productivity.

I claim:

1. A push-pull lock connector comprising:

a square sectioned plug housing made from an insulating material for housing a plurality of contacts and having an outer projection integrally formed on an outside thereof for engagement with a mating connector and a first stopper member integrally formed on said outside above said outer projection;

a square sectioned sliding sleeve surrounding and movable along an upper portion of said plug housing and having a second stopper member which is integrally formed to extend inwardly and cooperates with said first stopper member to restrict downward movement thereof and a front configuration which fits over said mating connector; and a pair of leaf springs secured to said second stopper member of said sliding sleeve in a square space between said square sectioned plug housing and said square sectioned sliding sleeve for biasing said sliding sleeve downwardly so that said sliding sleeve fits over said mating connector to thereby lock said outer projection to said mating connector.

2. A push-pull lock connector comprising:

a square sectioned plug housing for housing a plurality of contacts and having an outer projection integrally formed on an outside thereof for engagement with a mating connector and an outward flange formed on said outside above said outer projection;

a housing cap fitted over a top of said plug housing;

a square sectioned sliding sleeve surrounding an movable along an upper portion of said plug housing and having an inward flange which is integrally formed to extend inwardly and cooperates with said outward flange to restrict downward movement thereof and a front configuration which fits over said mating connection; and a pair of leaf springs secured to said inward flange of said sliding sleeve in a square space between said square sectioned plug housing and said square sectioned sliding sleeve for biasing said sliding sleeve downwardly so that said sliding sleeve fits over said mating connector to thereby lock said outer projection to said mating connector.

3. The push-pull lock connector of claim 2, wherein said leaf springs extends obliquely upwardly from a rectangular integral frame.

4. The push-pull lock connector of claim 2, wherein said leaf springs and said sliding sleeve are provided with first and second engaging means, respectively, with which said leaf springs are secured to said sliding sleeve.

5. The push-pull lock connector of claim 4, wherein said first and second engaging means are an hole bore in said leaf spring and a lance integrally formed on said inward flange.

6. The push-pull lock connector of claim 4, wherein said first and second engaging means are projections formed on opposite ends of said leaf spring and retention projections integrally formed on inside walls of said sliding sleeve.

7. The push-pull lock connector of claim 2, wherein said leaf springs have a V-shaped form.

8. The push-pull lock connector of claim 2, wherein said leaf springs have an inverted V-shaped form.

* * * * *